United States Patent [19]

Burke

[11] 4,428,572

[45] Jan. 31, 1984

[54] COMBINED SHEET INVERTER AND SORTER

[75] Inventor: Anthony E. Burke, Radlett, United Kingdom

[73] Assignee: Xerox Corporation, Stamford, Conn.

[21] Appl. No.: 301,996

[22] Filed: Sep. 14, 1981

[30] Foreign Application Priority Data

Sep. 25, 1980 [GB] United Kingdom ..... 8030937

[51] Int. Cl.[3] ..... B65H 29/32; B65H 31/24; B65H 29/54

[52] U.S. Cl. ..... 271/297; 271/DIG. 9; 271/197; 271/305; 271/311; 198/371

[58] Field of Search ..... 271/297, 184, DIG. 9, 271/65, 291, 305, 276, 311, 197, 194; 270/58; 209/656, 652; 198/371, 689, 400

[56] References Cited

U.S. PATENT DOCUMENTS

| | | | |
|---|---|---|---|
| 3,414,254 | 12/1968 | Snellman et al. | 270/58 |
| 3,500,999 | 3/1970 | Lippke | 271/197 |
| 3,612,249 | 10/1971 | Schneider | 198/38 |
| 3,666,262 | 5/1972 | Fowler et al. | 271/DIG. 9 |
| 3,716,178 | 2/1973 | Shimmin | 271/DIG. 9 |
| 3,774,906 | 11/1973 | Fagan et al. | 271/64 |
| 3,788,640 | 1/1974 | Stemmle | 271/64 |
| 3,799,541 | 3/1974 | Buccicone | 271/197 |
| 3,833,911 | 9/1974 | Caldwell et al. | 346/74 ES |
| 3,851,872 | 12/1974 | Gerbasi | 271/173 |
| 3,889,801 | 6/1975 | Boyer | 198/184 |
| 3,937,459 | 2/1976 | Lawrence | 271/173 |
| 3,944,207 | 3/1976 | Bains | 270/58 |
| 3,944,212 | 3/1976 | Stange et al. | 271/9 |
| 3,948,505 | 4/1976 | Miller et al. | 271/64 |
| 3,977,667 | 8/1976 | Cross et al. | 271/64 |
| 4,004,795 | 1/1977 | Agnew et al. | 271/233 |
| 4,015,841 | 4/1977 | Mitsumasu | 271/173 |
| 4,027,870 | 6/1977 | Frech et al. | 271/65 |
| 4,055,339 | 10/1977 | Looney | 271/173 |
| 4,078,789 | 3/1978 | Kittredge et al. | 271/65 |
| 4,111,410 | 9/1978 | Tates et al. | 271/173 |

FOREIGN PATENT DOCUMENTS

| | | | |
|---|---|---|---|
| 5041 | 10/1979 | European Pat. Off. | 271/297 |
| 2028284 | 3/1980 | United Kingdom | 271/297 |

OTHER PUBLICATIONS

IBM Technical Disclosure Bulletin, vol. 24, no. 7B, 1981.

IBM Technical Disclosure Bulletin, vol. 18, no. 1, Jun. 1975, "Sheet Turnover Device", p. 40.

IBM Technical Disclosure Bulletin, vol. 19, no. 12, May 1977, "Duplex Document Feeder", p. 4496.

*Primary Examiner*—Bruce H. Stoner, Jr.
*Assistant Examiner*—James E. Barlow
*Attorney, Agent, or Firm*—Bernard A. Chiama

[57] ABSTRACT

A combined sheet iverter and sorter comprises a plurality of bins B, a gate D associated with each bin which permits a sheet S to travel direction into the bin B, and a reversible conveyor 102 for advancing sheets past the bin openings and reversing the sheets into the bins B. The conveyor 102 is controlled so that each sheet is reversed when its trail edge is located between a pair of adjacent gates whereby the sheets S may be guided into selected bins B in accordance with a predetermined sequence.

8 Claims, 3 Drawing Figures

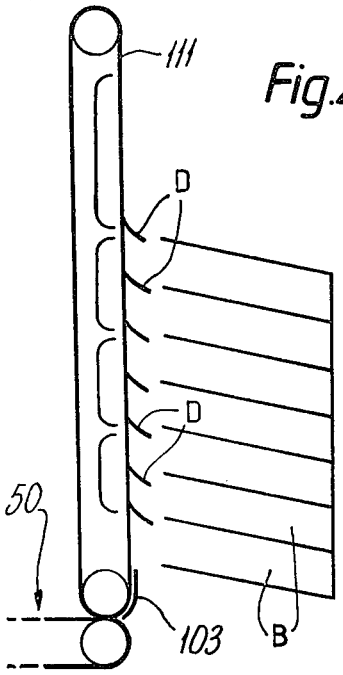
Fig.2.
Fig.3.
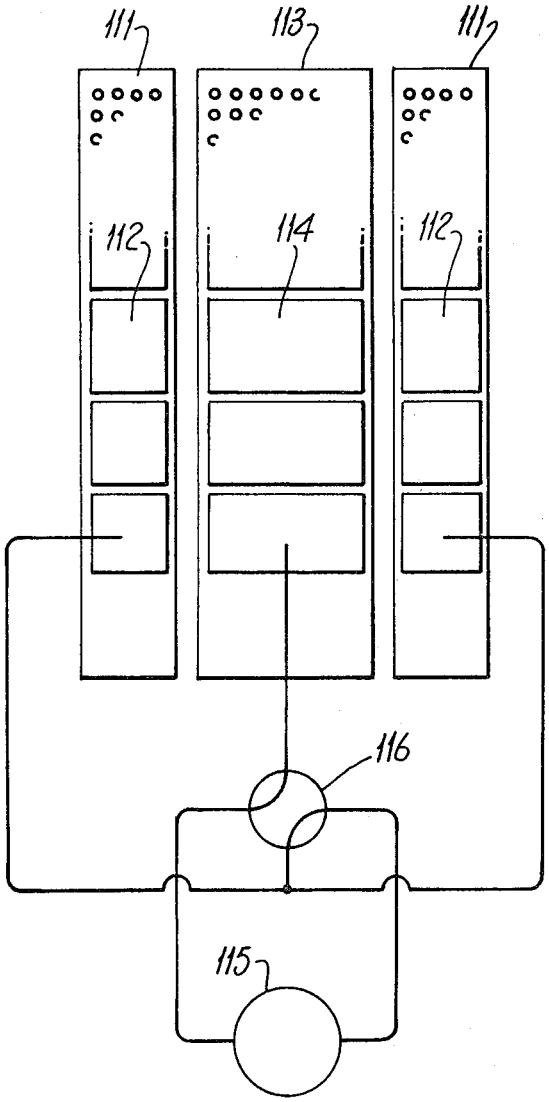

COMBINED SHEET INVERTER AND SORTER

BACKGROUND OF THE INVENTION

This invention relates to sorters for collating sheets into sets and is particularly concerned with combined sheet inverters and sorter suitable for use with or as part of an office reproduction machine.

Frequently, it is highly desirable to reproduce a plurality of copies of the same original document or information. Moreover, if several original documents are reproduced, it is desirable to form a plurality of collated sets of copies. This may be achieved by the utilization of a sorter. Generally, the sorter comprises a plurality of bins wherein each bin is designed to collect one set of copies of the original documents. A variety of sorters are known in the art.

Although rotary sorters having bins extending radially outwardly from an axis of rotation, as shown for example in U.S. Pat. No. 3,851,872 are known, most sorters used commercially with photocopiers are of the linear type. The latter comprise a plurality of tray members which are spaced apart and extend in a linear array, which may be horizontal, as for example in U.S. Pat. Nos. 3,944,207 and 4,015,814, or vertical as in U.S. Pat. No. 3,977,667. Linear sheet sorters themselves take various well-known forms.

There are travelling gate sorters as described for example in U.S. Pat. No. 3,414,254 in which sheets are conveyed by a sheet transport past the opening of a vertical array of bins and a movable gate or feed throat traverses across the bin openings for deflecting the sheets into the respective bins in turn. In moving bin sorters such as described in U.S. Pat. Nos. 3,788,640 and 4,055,339, the bins themselves are indexed past a fixed feet throat. A third type has fixed bins and a deflector or gate associated with each bin; a sheet transport advances the copy sheets past the bin openings and the deflectors are actuated in turn to guide the sheets from the transport into the respective bins. A desirable feature of such sorters is that the bin entrance openings of the respective bins are selectively increased in size by pivoting one or both of the tray members defining the openings as a sheet is fed into it.

In some document copiers or printers, the copy sheets exit from the processor face-up. By face-up is meant in relation to a simplex sheet that the printed side of the sheet is upwards and in relation to a duplex sheet that the odd-numbered side is upwards. The problem which occurs when sheets exit in number order from a processor face-up is that they become stacked in reverse number order so that for a set of sheets 1 to n, sheet n is on the top of the stack with sheet 1 at the bottom which is inconvenient for the user. In order to overcome this problem, copiers of the kind in which the sheets are delivered from the processor in face-up condition have included a sheet inverter. Examples of this are to be found in U.S. Pat. Nos. 3,833,911, 3,944,212, 3,977,677, 4,078,789 and 4,111,410 in which it will be seen that the sheets are turned over by the inverter so that they are delivered into the copy bins face-down. In the absence of an inverter, sheets delivered to a collection tray in the order 1 to n are stacked with sheet n at the top as shown for example in U.S. Pat. No. 3,938,802.

In U.S. Pat. No. 3,833,911, sheets being conveyed face-up along a horizontal transport are inverted by deflecting them upwardly from the horizontal transport onto a vertical vacuum transport using a movable deflector and then reversing the vertical transport to return the sheet to the horizontal transport around the lower end of the vertical transport so that it is still travelling in its original direction along the horizontal transport but is now face-down. In U.S. Pat. No. 4 078 789 the vertical transport inverter is replaced by a so-called tri-roll inverter comprising three contrarotating rolls at the entrance to a chute. The sheet is deflected between the centre roll and one outer roll which drive the sheet into the chute. As the trail edge of the sheet enters the chute it becomes aligned with the nip between the centre roll and the other roll which causes the sheet to be driven out of the chute with what was the trail edge now leading and the sheet is returned to the horizontal transport still travelling in the same direction by now face-down. U.S. Pat. No. 3,944,212 shows another tri-roll inverter. Such arrangements must be inserted along the sheet conveyor path and are space-consuming and because they comprise additional parts add significantly to the cost.

U.S. Pat. Nos. 3,977,667 and 4,111,410 show arrangements in which a copy sheet inverter is combined with a sorter. In both cases the sheets are inverted by transporting them over the top of a vertical sorter array and turning them back in the opposite direction as they enter the bins so that during their travel they are turned through 180°. These inverter arrangements rely on the configuration of the sorter and transport path and their relation to the copy sheet exit rolls of the processor. Such configuration and relation are not always desired or suitable.

Thus it is known from these U.S. patents to have a combined sheet inverter and sorter comprising a plurality of sheet-receiving bins, conveyor means opposite the bins for advancing sheets in one direction past the bin openings and a deflector associated with each bin for guiding a sheet into the bin.

SUMMARY OF THE INVENTION

A combined sheet inverter and sorter according to the present invention has each deflector arranged to permit a sheet to travel past the bin opening in said one direction but guide a sheet travelling in the opposite direction into the bin. The conveyor means is adapted to reverse the direction of sheet movement for feeding sheets into the bins, and means is provided for controlling the conveyor means so that each sheet is reversed when its trail edge is located between a pair of adjacent deflectors whereby the sheets may be guided into selected bins in accordance with a predetermined sequence.

Such apparatus is not limited in configuration in the same way as those described above and furthermore no mechanism is required for actuating the sheet deflectors. This enables a significant reduction in cost compared with the arrangements described in the aforesaid U.S. patents where mechanism is required for actuating the sheet deflectors.

In a preferred form, the deflectors comprise pivotally mounted fingers biassed to project into the path of a sheet on the conveyor for guiding a sheet into the associated bin, but which is deflected by the passage of a sheet in the first direction. The conveyor may be reversible or alternatively where increased speed of operation is desired, may comprise two transports each continuously driven in opposite directions and selectively engageable with a sheet thereon.

BRIEF DESCRIPTION OF THE DRAWINGS

In order that the invention may be more readily understood, reference will now be made to the accompanying drawings, in which:

FIG. 2 is a schematic side elevation of a second embodiment of sheet inverter and sorter according to the invention; and FIG. 3 is an end elevation of the apparatus of FIG. 2.

DESCRIPTION OF THE PREFERRED EMBODIMENTS

Figure 1:
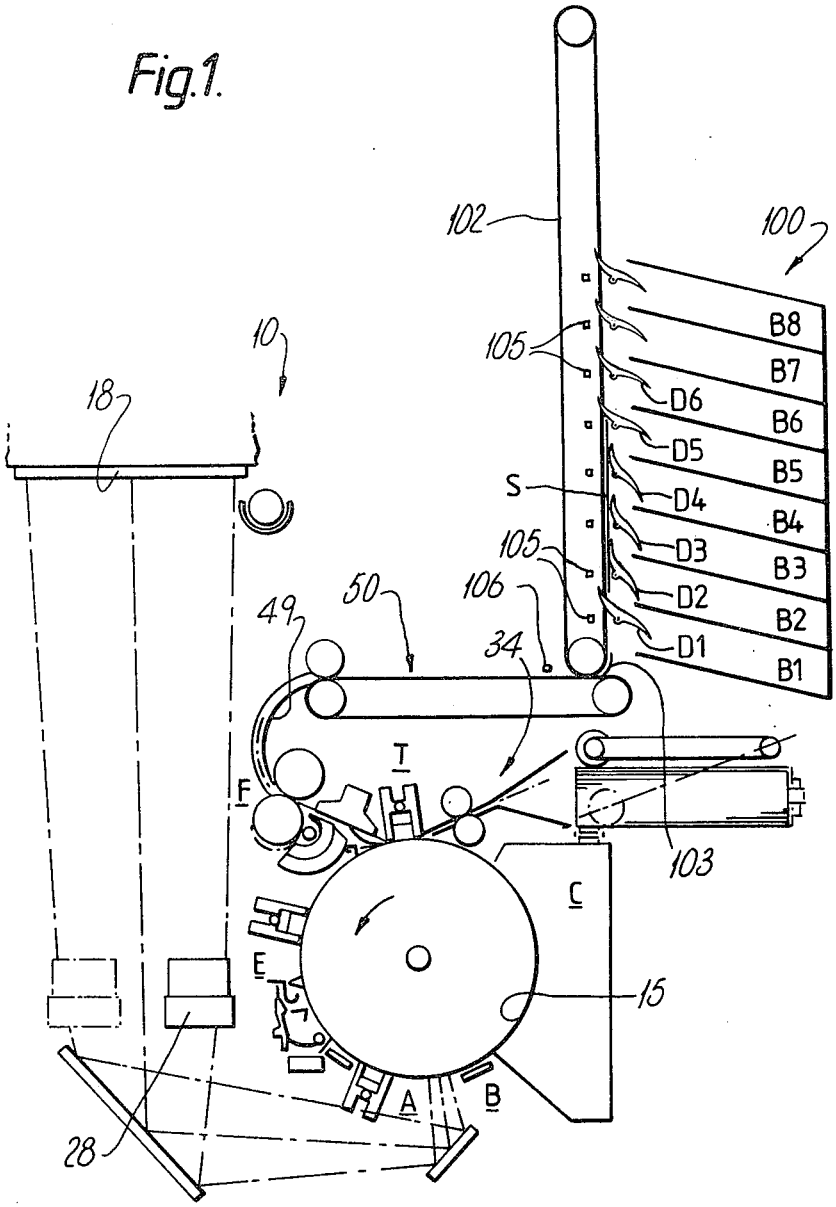
FIG. 1 shows schematically in side elevation a xerographic copier incorporating one embodiment of combined sheet inverter and sorter according to the invention.

Referring to FIG. 1 there is shown an automatic xerographic reproducing machine 10 incorporating a combined sheet inverter and sorter 100 according to this invention for collecting copy sheets produced in the machine 10. Although the present invention is particularly well suited for use in automatic xerography the apparatus 100 is equally well adapted for use with any number of devices in which cut sheets of material are delivered serially for collating into sets.

The processor 10 includes a photosensitive drum 15 which is rotated in the direction indicated so as to pass sequentially through a series of xerographic processing stations: a charging station A, an imaging station B, a developer station C, a transfer station D and a cleaning station E.

A document to be reproduced is placed on a platen 18 and scanned by means of a moving optical scanning system including lens 28 to produce a flowing light image on the drum at B. Cut sheets of paper are moved into the transfer station D from sheet registering apparatus 34 in synchronous relation with the image on the drum surface. The copy sheet is stripped from the drum surface and directed to a fusing station F. Upon leaving the fuser, the fixed copy sheet is passed through a curvilinear sheet guide system, generally referred to as 49, onto a horizontal vacuum transport 50 leading to the sorter 100. As will be apparent from a study of FIG. 1, the copy sheets are conveyed along the horizontal transport 50 to the sorter 100 face-up.

The combined sheet inverter and sorter 100 includes a plurality of sheet receiving bins B and a vertical vacuum transport 102 for advancing sheets S delivered by the horizontal transport 50 past the open ends or entrances of the bins 101. A guide 103 serves to transfer sheets from the horizontal transport 50 to the vertical transport 102. The vertical transport 102 is reversible so that it can be driven to convey sheets both upwards and downwards along the run facing the bin entrances. Associated with each bin is a deflector or gate D. Each deflector D comprises one or more pivotally mounted plastic fingers of low inertia which are lightly loaded by a spring or offset weight to project into the sheet path defined by the vertical transport 102. They operate like spring points (switches) on a railroad system so that when a sheet is conveyed upwards along the transport 102, the fingers are themselves deflected by the sheet which is able to travel along the conveyor unimpeded. By reversing the transport, a sheet is deflected by its trail edge engaging a deflector and guided into a bin 101. In FIG. 1, the deflectors D2, D3 and D4 associated with bins B2, B3, B4 are shown deflected by a sheet S being driven upwards along the vertical transport 102. The lowermost deflector D1 which was deflected by the passage of the sheet has now returned to its normal position projecting into the sheet path. By stopping the vertical transport at the position shown and reversing it, the sheet will be conveyed into the bin B1 being deflected and guided into the bin by the deflector D1. If the transport is stopped with the trail edge of the sheet between deflectors D2 and D3 then when the transport is reversed the sheet will be deflected and guided into bin B2. Thus by suitably controlling the reversal of the transport 102, a sheet may be guided into any desired bin B. It will be realised that during its passage between the horizontal transport 50 and the bin B, each sheet is inverted so that it is delivered face-down into the bin B with what was its trail edge now leading. Where sheets are being delivered to the sorter bins in number order (1 to N) this enables the sets compiled in the bins to be in number order with sheet 1 on the top and sheet N on the bottom of the set when it is removed from the sorter.

It will be realised that by varying the position at which reversal of the transport 102 occurs, the sheets can be inserted into the bins in accordance with a predetermined sequence. For sorting multiple copies of the pages of a document into sets in the sorter, the sorter is controlled by the machine logic to insert successive copies of each page into successive bins, this process being repeated for each page so as to build up a set of pages in each bin. However, the sorter may be programmed to deliver sheets in any desired sequence (for example it may be utilized for mail routing) and is suitably controlled by a microprocessor.

For each copy, selection of the appropriate bin may be effected by a sensor 105, such as a microswitch, pneumatic detector or photodetector, associated with each bin B which detects when the sheet trail edge has passed the relevant deflector D. Or a single sensor 106 could detect the passage of the trail edge at an early point in the inverter path ahead of all the deflectors, reversal being effected a timed interval after sensing.

It will be understood that in the arrangement described above, each sheet must clear the transport 102 before the next sheet enters the transport. It may be impractical to run the inverter transport 102 fast enough for this depending on the output rate of the xerographic processor. An alternative mode of controlling the movement of the copies which permits increased speeds of operation is shown in FIGS. 2 and 3. In its simplest form there are at least two transport belts continuously driven in opposite directions and these belts are selectively engageable with a sheet. As shown, a pair of perforated vacuum belts 111 are driven so as to propel the copy upwards when vacuum is applied to the chambers 112 behind them. A single perforated vacuum belt 113 is driven so as to propel the copy downwards when vacuum is applied similarly to the chamber 114. When chamber 112 is under vacuum, chamber 114 is under slight positive pressure, and vice versa. Air supply for these chambers may be from a combined vacuum pump and blower 115 associated with valves 116 controlled by the machine logic. The chambers 112 and 114 are each in several vertical sections with each set of chambers controlled by its own valve 116.

By dividing the transport into sections in this way greater speeds of operation may be achieved. For maximum speed of operation, there will be as many sections as there are bins in the sorter. However, depending on the speed of the processor and the speed at which the belts can be driven, only three or four sections may be necessary for a 12-bin sorter.

It will be understood from the foregoing that the present invention provides a combined sheet inverter and sorter by which sheets delivered face-up may be collated into sets in number order. Inverting and sorting is achieved using one or several copy position sensing elements and or reversing sheet transport which is anyway required for the inverter, but without moving bins or a moving deflector or deflectors requiring control and energisation. Cost is reduced and reliability increased.

Although specific embodiments have been described, modifications may be made to the specific details referred to herein without departing from the scope of the invention as defined in the appended claims. Thus although the transports 102 of both embodiments illustrated employ vacuum belts, these may be replaced by belts associated with pressure rolls which in the embodiment of FIGS. 2 and 3 are selectively engageable.

It will be realised that an inverter/sorter according to this invention may be integral with a copier as in FIG. 1 or a separate module or unit as in FIGS. 2 and 3.

I claim:

1. In a combined sheet inverter and sorter comprising a plurality of sheet-receiving bins, conveyor means opposite the bins for advancing sheets in one direction past the bin openings, and a deflector associated with each bin for guiding a sheet into the bin, the improvement including means for mounting each deflector to permit a sheet to travel past the bin opening in said one direction but to guide a sheet travelling in the opposite direction into the bin, said conveyor means including means adapted to reverse the direction of sheet movement for feeding sheets into the bins, and control means associated with said conveyor means for controlling the operation of the conveyor means so that each sheet is reversed when its trail edge is located between a pair of adjacent deflectors whereby the sheets may be guided into selected bins in accordance with a predetermined sequence.

2. A combined sheet inverter and sorter according to claim 1 wherein each deflector is biased to project into the path of a sheet in the conveyor for guiding a sheet into the associated bin, and being movably mounted for deflection by the passage of a sheet in said first direction.

3. A combined sheet inverter and sorter according to claim 2 wherein each deflector comprises at least one pivotally mounted finger.

4. A combined sheet inverter and sorter according to claim 1 wherein said conveyor means comprises a reversible sheet transport.

5. A combined sheet inverter and sorter according to claim 1 wherein said conveyor means comprises two transports driven in opposite directions and means for selectively engaging one or other transport with a sheet on the conveyor.

6. A combined sheet inverter and sorter according to claim 5 wherein each transport is divided into sections along its length, each section being individually selectable for engagement or disengagement with a said sheet.

7. A combined sheet inverter and sorter according to claim 1, including means for sensing the passage of a sheet past a fixed point, said direction of sheet movement being reversed after a time interval which is variable in dependence upon the bin selected.

8. A combined sheet inverter and sorter according to claim 1 wherein a sensor is associated with each deflector to detect when the sheet trail edge has passed that deflector.

* * * * *